United States Patent [19]

Shimoma et al.

[11] Patent Number: 4,945,284

[45] Date of Patent: Jul. 31, 1990

[54] ELECTRON GUN FOR COLOR-PICTURE TUBE DEVICE

[75] Inventors: Taketoshi Shimoma, Isesaki; Shinpei Koshigoe, Fukaya; Takahiro Hasegawa, Gyouda, all of Japan

[73] Assignee: Kabushiki Kaisha Toshiba, Kanagawa, Japan

[21] Appl. No.: 320,740

[22] Filed: Mar. 8, 1989

[30] Foreign Application Priority Data

Mar. 11, 1988 [JP] Japan ..... 63-57581

[51] Int. Cl.[5] ..... H01J 29/58

[52] U.S. Cl. ..... 313/414; 313/449; 315/3; 315/15; 315/382

[58] Field of Search ..... 313/414, 449, 442, 452, 313/460; 315/14, 15, 382, 3

[56] References Cited

U.S. PATENT DOCUMENTS

| | | | |
|---|---|---|---|
| 4,514,661 | 4/1985 | Stone | 313/414 X |
| 4,531,075 | 7/1985 | Stone | 315/3 |
| 4,728,859 | 3/1988 | Natsuhara et al. | 313/414 X |
| 4,763,047 | 8/1988 | Watanabe et al. | 315/382 |
| 4,814,670 | 3/1989 | Suzkui et al. | 313/414 X |

FOREIGN PATENT DOCUMENTS

| | | |
|---|---|---|
| 61-39346 | 2/1986 | Japan . |
| 61-39347 | 2/1986 | Japan . |

*Primary Examiner*—Donald J. Yusko
*Assistant Examiner*—Michael Horabik
*Attorney, Agent, or Firm*—Finnegan, Henderson, Farabow, Garrett and Dunner

[57] ABSTRACT

An electron gun for color-picture tube device comprises a final accelerating electrode and a focusing electrode divided into plural electrode units in the axial direction of the tube. A first focusing electrode unit adjacent to the final accelerating electrode is connected to a second focusing electrode unit adjacent to the first focusing electrode unit through a resistor. A focusing voltage being change in synchronous with the deflection of an electron beam is applied to the first focusing electrode unit. The resistor is used for removing the a.c. components from the focusing voltage. Then, the removed focusing voltage is applied to the second focusing electrode. For the electron beam deflected on the peripheral part of the screen, a quadrupole lens is formed. On the first focusing electrode unit side opposite to the second focusing electrode unit are formed first electron beam path holes whose major axes extend horizontally. On the second focusing electrode unit side opposite to the first focusing electrode unit are formed second electron beam path holes whose major axes extend vertically. As a result, the quadrupole lens serves to suppress a halo portion.

4 Claims, 7 Drawing Sheets

ELECTRON GUN FOR COLOR-PICTURE TUBE DEVICE

FIELD OF THE INVENTION AND RELATED ART STATEMENT

The present invention relates to an electron gun used for a color-picture tube device.

Recently, a normal electron gun for color-picture tube is an inline type triple-gun tube device.

The inline type triple-gun tube comprises three cathodes disposed on one plane, a first grid and a second one common to these cathodes, and a focusing electrode having two or more electrodes respectively with a plurality of holes and being disposed at given intervals in the axial direction of the tube. The three cathodes and the first and the second grids serve to generate three electron beams, and then the focusing electrode allows the three electron beams to pass through the holes for focusing these beams. And, the inline type triple-gun color-picture tube normally provides a deflection yoke, which generates an inhomogeneous magnetic field consisting of a pin-cushion type horizontally-deflected magnetic field as shown in FIG. 1(*a*) and a barrel type vertically-deflected magnetic field as shown in FIG. 1(*b*). The deflection yoke thus allows the three electron beams to self-convergence on a fluorescent surface. In FIG. 1, B1, B2, and B3 respectively denote electron beams emitted from the inline electron gun. Curves show magnetic fields.

This type of self-convergence deflection system does not require an additional device for convergence three electron beams such as a dynamic convergence device, which means it is less costly and allows easier focusing control. Hence, the color-picture tube employing the inline type triple-electron gun greatly contributes to the quality and performance of a color-picture tube.

The inhomogeneous magnetic field brings about an adverse effect of lowering resolution on the peripheral part of the screen of the color-picture tube. The adverse effect is more distinguished as the deflection angle increases from 90° to 110°.

This effect results from the fact that the inhomogeneous magnetic field of the deflection yoke as shown in FIGS. 1(*a*) and (b) weakens horizontal focusing level of the electron beams and strengthens vertical focusing level of them to the contrary. As a result, a beam spot 1, which is located on the center of the screen, is substantially circular, but a beam spot 2, which is located on the peripheral part of the screen, is formed to have an elliptic high brightness core portion 3 extending horizontally and a low brightness halo portion 4 extending vertically.

The halo portion formed with the electron beam spot on the peripheral part of the screen results from the fact that the electron beam is vertically over-focused.

For means for reducing the inferior resolution caused by the distortion of the deflected electron beam, the following methods have been mainly employed;

(1) The use of a pre-focusing lens enables an electron beam to be focused intensely, resulting in reducing the diameter of an electron beam passing through a deflected magnetic field and a main lens and thus lightening the deflection distortion caused by the inhomogeneous magnetic field.

(2) Using an asymmetric lens for the pre-focusing lens and under-focusing an electron beam in the vertical direction, these result in relaxing the vertical focusing level caused by the inhomogeneous magnetic field and reducing the over-focusing level.

(3) Dividing a focusing electrode into plural electrode units, applying a focusing voltage to one focusing electrode unit, and applying a focusing voltage changed in synchronous with the deflection on the other focusing electrode units, these result in forming a quadruple lens, which serves to apply a divergent effect to an electron beam for lightening the vertical over-focusing level (Official Gazettes of Japanese Patent Laid-open Nos. Sho. 61-39346 and Sho. 61-39347).

The above methods allow the resolution on the peripheral part of the screen to be improved.

Yet, the (1) and (2) methods have a shortcoming that the resolution on the center of the screen is made inferior, because the use of the former method increases a crossover diameter, thus expanding the electron beam spot diameter on the center of the screen, and the latter method allows the electron beam spot on the center of the screen to have an elliptic form whose major axis extends vertically.

The (3) method allows excellent resolution on the center and peripheral part of the screen. This method, however, requires two focusing power sources, because it is necessary to apply the focusing voltage being changed in synchronous with the deflected electron beam to at least one of the focusing electrode units and to apply the other focusing voltage to the other focusing electrode units.

In general, since the focusing voltage needs a high voltage such as 7 to 8 kV, an associated socket supplies one focusing voltage only. On the contrary, the (3) method requires a special device to be connected with the socket for preventing discharge, since it needs two focusing voltages. The (3) method has a shortcoming that compatibility with the conventional picture tube is lost.

As set forth above, the self-convergence type color-picture tube employing an inline type electron gun greatly contributes to improve the quality and performance of the color-picture tube. However, it has inferior resolution on the peripheral part of the screen. To improve the resolution, it has been necessary to lower the resolution on the center of the screen or to give up compatibility with the conventional picture tube.

OBJECT AND SUMMARY OF THE INVENTION

It is an object of the present invention to provide an electron gun for color-picture tube which presents excellent resolution on the center and peripheral part of the screen.

It is another object of the invention to provide an electron gun for color-picture tube which suppresses or eliminates a halo portion on the peripheral part of the screen.

It is a further object of the invention to provide an electron gun for color-picture tube which keeps compatibility with the conventional picture tube.

According to the invention, the electron gun for a color-picture tube device comprises a cathode for generating an electron beam, a focusing electrode, and a final accelerating electrode, these electrodes composing an electron lens for focusing the electron beam and being disposed in the axial direction of the tube. The electron gun is characterized by dividing the focusing electrode into plural electrode units in the axial direction of the tube, connecting a first focusing electrode unit adjacent to the final accelerating electrode with a second focusing electrode unit adjacent to the first focusing electrode unit through a resistor means, applying a focusing voltage being changed in synchronous with the deflected electron beam to the first focusing electrode unit, applying to the second focusing electrode unit the focusing voltage whose a.c. components are substantially removed through the resistor means, forming on the first focusing electrode unit side opposite to the second focusing electrode unit a first electron beam path holes whose major axes extend horizontally, and forming on the second focusing electrode unit side opposite to the first focusing electrode second electron beam path holes extending in the direction orthogonal to the first electron beam path holes.

The focusing voltage being changed in synchronous with the deflected electron beam is a combination of a dynamic voltage having a potential difference of 1000 to 2000 V between a minimum value and a maximum one and a d.c. voltage of 7000 to 8000 V, wherein the minimum value is synchronized with the electron beam spot on the center of the screen, the maximum value is synchronized with that on the peripheral part of the screen, and the voltage is a parabolic wave voltage whose convex portion is directed lower.

The resistance given by the resistor means has a value which is not large enough to convey the dynamic components of the focusing voltage to the next electrode. Normally, it is equal to or more than the output impedance of a dynamic voltage occurrence circuit.

In the electron gun for a color-picture tube device according to the invention, the focusing voltage being changed in synchronous with the deflected electron beam is applied to the first focusing electrode unit adjacent to the final acceleration electrode, and then it is applied to the second focusing electrode unit after the resistor means removes the a.c. components from the focusing voltage. That is, both of the d.c. and a.c. components composing the focusing voltage are applied to the first focusing electrode, and the d.c. components are merely applied to the second focusing electrode unit.

A potential difference corresponding to the a.c. components is raised between the first and the second focusing electrodes, so that a quadrupole electrode lens is formed between the first and second focusing electrode units.

When the electron beam is deflected to the center of the screen, it is focused by the main lens only, but when it is deflected to the peripheral part of the screen, it is focused by the main lens and the quadrupole electrode lens.

The first electron beam path holes are formed on the first focusing electrode unit side opposite to the second focusing electrode, and on the second focusing electrode unit side opposite to the first focusing electrode are formed the second electron beam path holes extending in the direction orthogonal to the first electron beam path holes. Hence, the quadrupole electrode lens can apply a horizontal focusing function and a vertical divergent function. It results in under-focusing the vertical components of an electron beam, thus solving the vertical over-focusing phenomenon and suppressing or removing a halo portion.

It is, therefore, possible to improve the resolution on the peripheral part of the screen without having to lower the resolution on the center of the screen.

And, since the supply terminal for a focusing voltage needs the first focusing electrode only, as usual, this electron gun keeps compatibility with the conventional picture tube.

DETAILED DESCRIPTION OF PREFERRED EMBODIMENTS

Figure 1A:
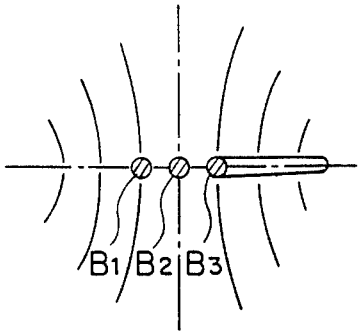
FIG. 1(*a*) is a view conceptually showing a pin-cushion type magnetic field, and FIG. 1(*b*) is a view conceptually showing a barrel type magnetic field.
Figure 1B:
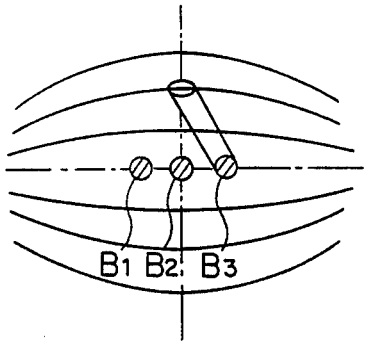

Hereinafter, reference will be directed to the electron gun for a color-picture tube device according to the invention with reference to the drawings.

The common members in the drawings have the same reference numbers.

Figure 3A:
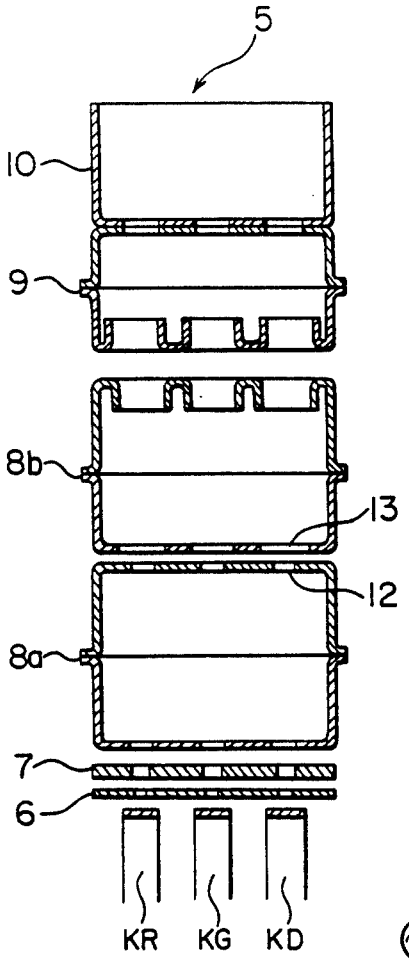
FIG. 3(*a*) is a schematic plan section showing one embodiment of an electron gun for color-picture. The tube device according to the invention, and FIG. 3(*b*) is a schematic side section showing the electron gun shown in FIG. 3(*a*)
Figure 3B:
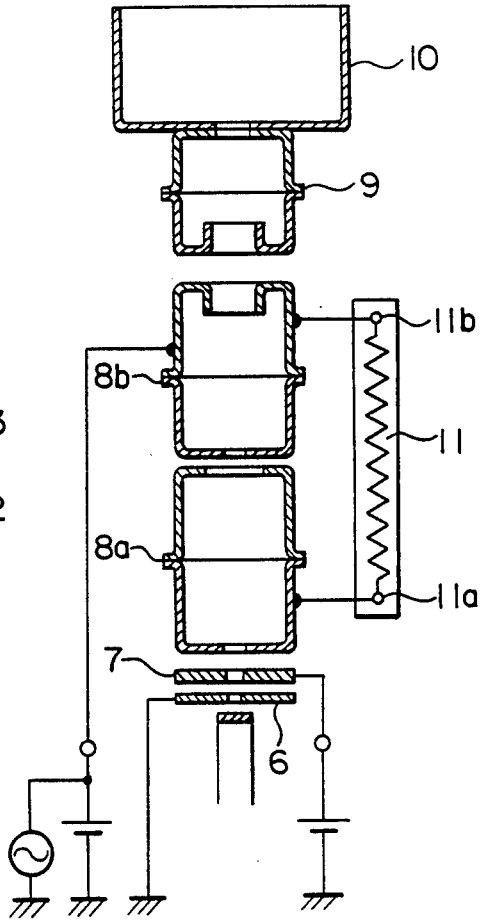

FIG. 3(*a*) is a schematic plan section showing one embodiment of an electron gun for a color-picture tube device according to the invention, and FIG. 3(*b*) is a schematic side section showing the above.

In FIG. 3(*a*), an electron gun 5 provides a heater (not shown) inside of itself and comprises three cathodes KR, KG, and KB disposed in a line, a second focusing electrode 8*a*, a first focusing electrode 8*b*, a final acceleration electrode 9, and a convergence cup 10 disposed in the axial direction of the tube. The electron gun 5 is supported and secured by an insulating supporting rod (not shown).

Near the electron gun 5 is provided a resistor 11 shown in FIG. 3(*b*). One terminal 11*a* of the resistor 11 is connected to the second focusing electrode 8*a*, and the other terminal 11*b* is connected to the first focusing electrode 8*b*. A focusing voltage is supplied to the first focusing electrode 8*b* through a lead wire from a stem (not shown).

The first electrode 6 is a thin plate-like electrode having three electron beam path holes respectively with small diameters.

The second electrode 7 is also a thin plate-like electrode having three electron beam holes respectively with small diameters.

The second focusing electrode 8*a* and the first focusing electrode 8*b* composes a combination of cup-like electrodes.

On the second focusing electrode 8*a* side opposite to the second electrode 7 are formed three electron beam path holes whose diameters are somewhat larger than those of the second electrode 7. On the side opposite to the first focusing electrode 8*b* are formed three square electron beam path holes 12 (second electron beam path holes), respective major axes of which extend vertically as shown in FIG. 4(*a*).

Figure 4A:
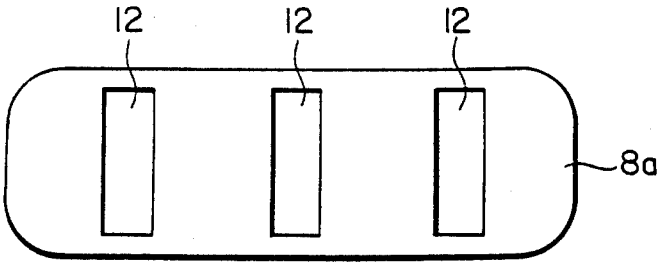
FIG. 4(*a*) is a view showing electron beam path holes formed on the first focusing side opposite to the second focusing electrode shown in FIG. 3, and FIG. 4(*b*) is a view showing electron beam path holes formed on the second focusing electrode side opposite to the first focusing electrode shown in FIG. 3.
Figure 4B:
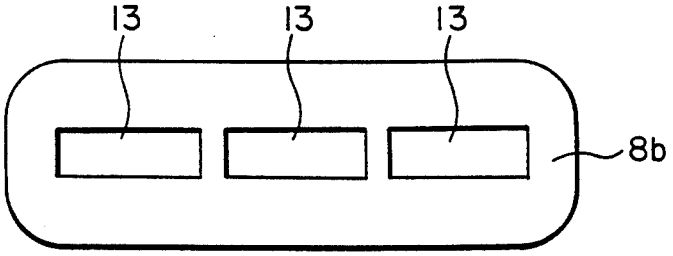
Figure 5:
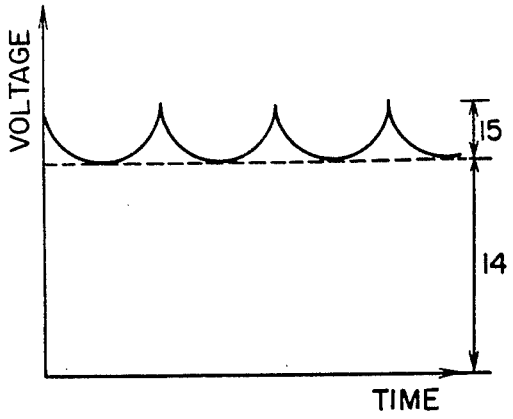
FIG. 5 is a view showing the focusing voltage applied to the second focusing electrode shown in FIG. 3.
Figure 6:
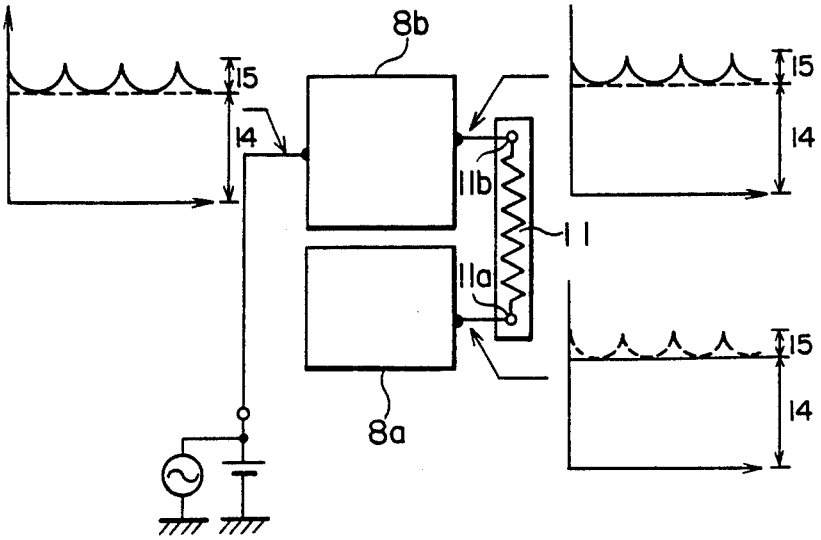
FIG. 6 is an explanatory view for describing the function of a resistor, shown in FIG. 3.

On the first focusing electrode 8*b* side opposite to the second focusing electrode 8*a* are formed three square electron beam path holes 13 (first electron beam path holes), respective major axes of which extend horizontally as shown in FIG. 4(*b*). On the first focusing electrode 8*b* side opposite to the final accelerating electrode 9 are formed three circular electron beam path holes respectively with larger diameters.

The final accelerating electrode 9 is composed of two cup-like electrodes. On both sides opposite to the first focusing electrode 8*b* and the convergence cup 10 are formed three circular electron beam path holes respectively with larger diameters.

The cathodes KR, KG, and KB in the electron gun 5 receives an applied d.c. voltage of about 150 V and a modulation signal for a picture, the first electrode 6 is grounded, and the second electrode 7 receives an applied d.c. voltage of about 600 V. And, the second focusing electrode 8*a* receives an applied focusing voltage of about 7 kV, the first focusing electrode 8*b* receives an applied focusing voltage of about 7 to 8 kV, and the final accelerating electrode 9 receives an applied high voltage of 25 kV to 30 kV.

The cathodes KR, KG, and KB, the first electrode 6, and the second electrode 7 compose a triode, which emits an electron beam and forms a crossover.

The electron beam emitted by the triode is preliminarily focused through the effect of a pre-focusing lens composed between the second electrode 7 and the second focusing electrode 8*a* and then finally focused by the main lens composed of the second focusing electrode 8*b* and the final accelerating electrode 9.

Next, details will be directed to the operation of the electron gun 5 with reference to FIGS. 5 to 8.

A focusing voltage is applied to the first focusing electrode 8*b* through a lead wire from the stem. This focusing voltage is a superposed combination of a d.c. voltage 14 of 7000 V and a dynamic voltage 15 of about 1000 V being changed in a parabolic manner in synchronous with the deflection. The dynamic voltage 15 is about 1000 V when the electron beam is deflected to the peripheral part of the screen, and it is 0 V when the electron beam is deflected to the center of the screen.

The focusing voltage is applied to the first focusing electrode 8*b* and then is applied to the second focusing electrode 8*a* through the resistor 11. Assuming that the resistance afforded by the resistor 11 is about 200 kΩ, from a d.c. voltage point of view, the focusing voltage applied to the second focusing electrode 8*a* stays at the same level as the terminal 11*b* of the resistor 11, but from an a.c. voltage point of view, it stays in the insulating state, thus supplying no dynamic voltage 15.

When the electron beam reaches on the center of the screen, the second focusing electrode 8*a* is at the same potential level as the first focusing electrode 8*b*, since no dynamic voltage 15 is supplied to both the second focusing electrode 8*a* and the first focusing electrode 8*b*. Hence, a quadrupole lens is not formed between the second focusing electrode 8*a* and the first focusing electrode 8*b*, so that the electron beam is focused by the main lens.

When the electron beam reaches on the peripheral part of the screen, the dynamic voltage 15 is supplied to the first focusing electrode 8*b*, but not to the second focusing electrode 8*a*, so that a potential difference of about 1000 V is raised between the second focusing electrode 8*a* and the first focusing electrode 8*b*. These electrodes 8*a* and 8*b*, therefore, compose the quadrupole lens, which affords a horizontal focusing effect and a vertical divergent effect to the electron beam. It means that, viewed from the main lens, the horizontal virtual point is not neatly overlapped with the vertical virtual point. The horizontal focusing state of the electron beam thus is different from the vertical focusing state thereof.

Figure 7:
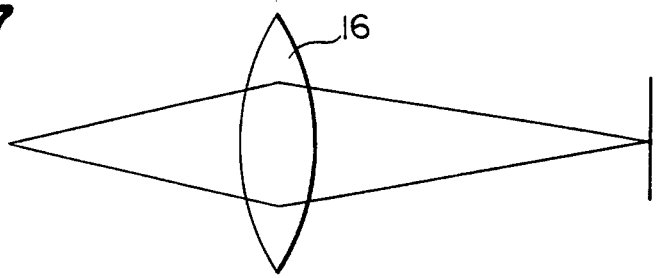
FIG. 7 is a model view showing an optical model system for describing the operation principle of a main lens when the electron beam of the electron gun is deflected to the center of the screen.
Figure 8A:
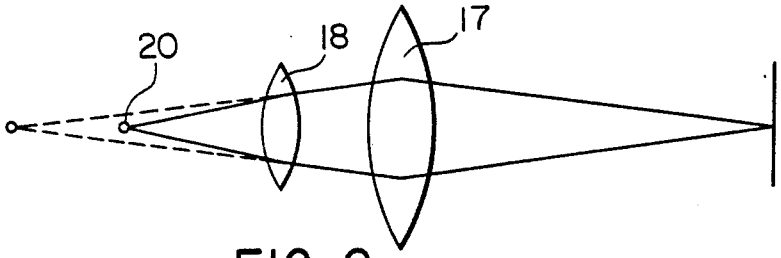
FIG. 8(*a*) is a model view showing an optical model system for describing the principle of horizontal operation of a quadrupole electrode lens and a main lens when the electron beam is deflected to the peripheral part of the screen in the electron gun shown in FIG. 3, and FIG. 8(*b*) is a model view showing an optical model system for describing the principle of vertical operation of the above.
Figure 8B:
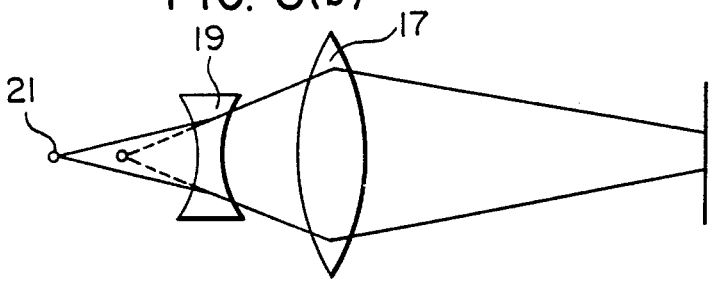
Figure 9:
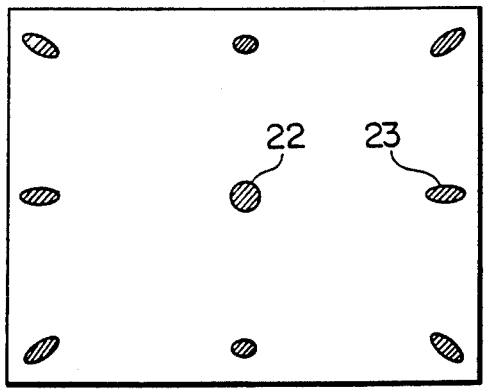
FIG. 9 is a schematic view showing the sectional forms of electron beam spots on the center and peripheral part of the screen when the electron gun for a color-picture tube device shown in FIG. 3 is employed.

FIGS. 7 and 8 show a model optical system.

When the electron beam reaches on the center of the screen, it is focused by the main lens 16 only, so that the circular beam spot is formed on the screen.

Next, when the electron beam reaches on the peripheral part of the screen, it is focused by the main lens 17 and the quadrupole lens 18, 19 as shown in FIGS. 8(*a*) and (*b*). At a time, a potential difference between the first focusing electrode 8*b* and the final accelerating electrode 9 is made smaller, thus making the focusing effect of the main lens 17 weaker than that of the main lens 16 as shown in FIG. 7.

As shown in FIG. 8(*a*), the quadrupole lens 18 affords a horizontal focusing effect to the electron beam as shown in FIG. 8(*a*), but the electron beam can be focused very neatly, since the main lens 17 affords a weak focusing effect. At this time, the virtual point 20 apparently comes backward in the axial direction.

As shown in FIG. 8(*b*), the electron beam stays in the under-focusing state, because the quadrupole lens 19 affords a vertically divergent effect to the electron beam, together with the weak focusing effect afforded by the main lens 17. As a result, this under-focusing state serves to solve deflecting defocusing in the over-focusing state, when the vertical virtual point 21 of the electron beam apparently comes backward in the axial direction.

Figure 2:
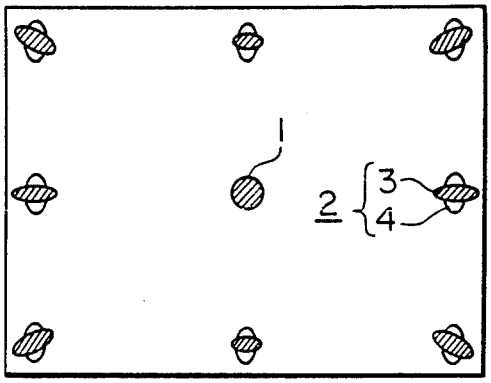
FIG. 2 PRIOR ART
FIG. 2 is a schematic view showing the section forms of electron beam spots on the center and peripheral part of the screen of the conventional color-picture tube device.

As set forth above, according to this embodiment, the electron beam spot 22 on the center of the screen has a circular form, and the electron beam spot 23 on the peripheral part of the screen has a form with no halo portion (see FIG. 2), resulting in obtaining high resolution over the whole screen.

Moreover, the electron gun according to the embodiment requires no supply terminal to the second focusing electrode 8*a* but just one supply terminal to the first focusing electrode 8b. Hence, as usual, the electron gun needs one supply terminal only so that it can keep compatibility with the conventional color-picture device.

Figure 10:
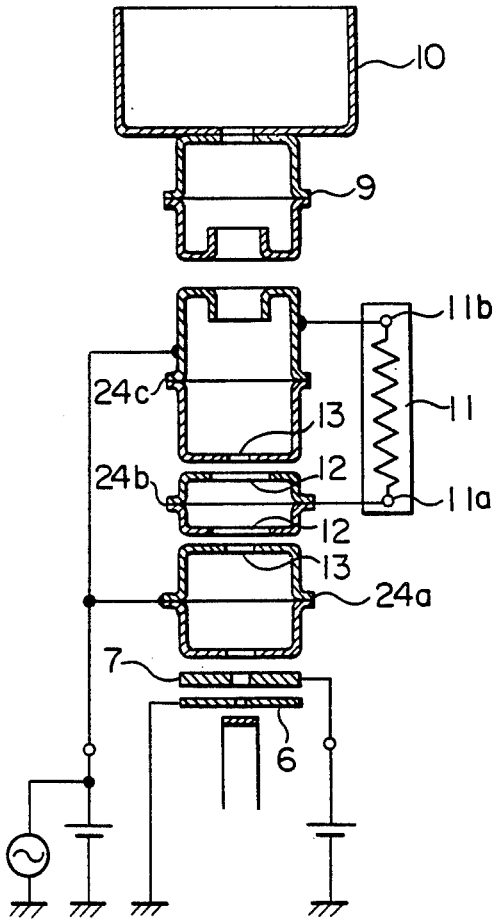
FIG. 10 is a schematic vertical section showing another embodiment of the electron gun for a color-picture tube device according to the invention.

In the foregoing embodiment, the focusing electrode is divided into two units, that is, the second focusing electrode 8a and the first electrode 8b. As shown in FIG. 10, however, the invention may be applied to the construction wherein the focusing electrode is divided into three electrode units, that is, a first focusing electrode 24c, a second focusing electrode 24b, and a third focusing electrode 24a.

On the second focusing electrode 24a side opposite to the second electrode 7 are formed circular electron beam path holes 13. On the other side opposite to the second focusing electrode 24b are formed elliptic electron beam path holes whose major axes extend horizontally as shown in FIG. 4(*b*). Elliptic electron beam path holes 12 whose major axes extend vertically are formed on both sides of the second focusing electrode 24b, those sides opposite to the third focusing electrode 24a and the first focusing electrode 24c. And, on the first focusing electrode 24c side opposite to the second focusing electrode 24b are formed elliptic electron beam path holes 13 whose major axes extend horizontally as shown in FIG. 4(*b*). On the other side opposite to the final accelerating electrode 9 are formed circular electron beam path holes.

One terminal 11a of the resistor 11 is connected to the second focusing electrode 24b, and the other terminal 11b is connected to the first focusing electrode 24c. Like the foregoing embodiment, the focusing voltage composed of the d.c. voltage 14 and the dynamic voltage 15 is applied to the first focusing electrode 24c and the third focusing electrode 24a.

The focusing voltage applied to the first focusing electrode 24c is also applied to the second focusing electrode 24b through the resistor 11. When the electron beam reaches on the peripheral part of the screen, a quadrupole lens is formed near the second focusing electrode 24b. This quadrupole lens serves to solve the deflecting defocusing of the electron beam on the basis of the operation principle described in FIGS. 5 to 8.

The presence of floating capacitance between respective electrodes composing the focusing electrode enables the a.c. components of the voltage to be derived on the electrode to which only the d.c. components are applied, because the dynamic voltage applied on the adjacent electrode serves to derive those a.c. components. As a result, the potential difference between both electrodes may be different from a desired value. It may be thus impossible to obtain a desired focusing effect and divergent effect afforded by the electron lens.

To solve this shortcoming, a capacitive element is connected to a focusing electrode to which only the d.c. voltage of the focusing voltage is applied.

Figure 11:
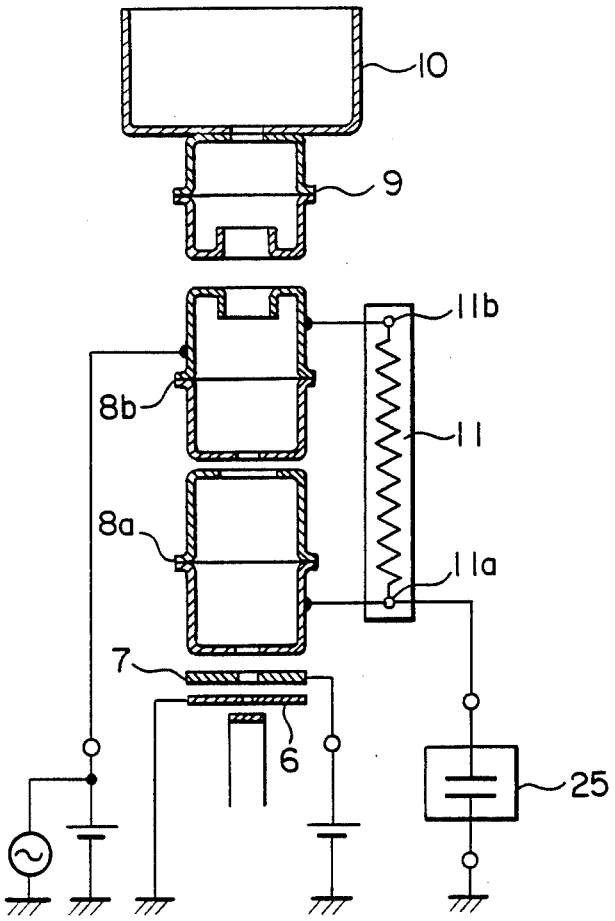
FIG. 11 is a schematic vertical section showing another embodiment of the electron gun for a color-picture tube device according to the invention.

For example, as shown in FIG. 11, one end of a capacitive element 25 is connected to the second focusing electrode 8a of the electron gun 5 shown in FIG. 3. The other end is grounded.

The capacitance of the capacitive element 25 should be ten times as much as the floating capacitance existing between the first focusing electrode 8b and the second focusing electrode 8a. The capacitance allows eliminating the a.c. components derived by the dynamic voltage 15 included in the focusing voltage. Hence, a given potential difference is generated between the electrode to which only the d.c. voltage contained in the focusing voltage must be applied and the electrode to which the focusing voltage composed of the d.c. voltage and the superposed dynamic voltage therewith must be applied.

By fixing thin metal plates on both surfaces of a ceramic thin plate, the capacitive element 25 can be easily made.

According to the foregoing description of the embodiment, the electron gun employs a bi-potential type electron gun as a standard type. However, this invention may be applied to another type electron gun such as a uni-potential type, a quadru-potential type, or a tri-potential type.

Further, the foregoing description has employed the focusing electrode composed of two electrodes or three ones, but the invention may be applied to the focusing electrode composed of four electrodes.

The foregoing embodiment has employed the circular electron beam path holes formed on the electrodes composing the main lens, but the invention may employ non-circular holes or large-diameter holes common to plural electron beams.

The invention is designed for achieving high quality of the self-convergence type color-picture tube device employing the inline type electron gun. However, though the fundamental principle of the invention may be applied to another type electron gun for color-picture tube device such as a delta type electron gun, a single beam type one, or another multiple beam type one.

What is claimed is:

1. An electron gun for color-picture tube device comprising cathodes for generating electron beams, and a focusing electrode and a final accelerating electrode composing an electron lens for focusing said electron beam, said electrodes being disposed in the axial direction of said tube, whereby said focusing electrode is divided into plural electrode units in the axial direction of the tube, a first focusing electrode unit adjacent to said final accelerating electrode is connected to a second focusing electrode unit adjacent to said first focusing electrode unit through a resistor means, a focusing voltage being changed in synchronous with the deflection of said electron beam is applied to said first focusing electrode unit, the resistor means removes the substantial a.c. components from the focusing voltage, the resulting focusing voltage is applied to said second focusing electrode unit, first electron beam path holes whose major axes extend horizontally are formed on said first focusing electrode side opposite to said second focusing electrode unit, and second electron beam path holes whose major axes extend in the direction orthogonal to said first electron beam path holes are formed on said second focusing electrode unit side opposite to said first focusing electrode unit.

2. The electron gun for color-picture tube device claimed in claim 1 wherein said focusing electrode is divided into two electrode units in the axial direction of said tube.

3. The electron gun for color-picture tube device claimed in claim 1 wherein said focusing electrode is divided into three electrode units in the axial direction of said tube.

4. The electron gun for color-picture tube device claimed in claim 1 wherein said second focusing electrode unit is connected to a capacitive element.

* * * * *